US007220712B1

(12) United States Patent
Maggi

(10) Patent No.: US 7,220,712 B1
(45) Date of Patent: May 22, 2007

(54) COMPOSITIONS AND METHODS FOR CLEANING AND CONDITIONING

(76) Inventor: Anthony G. Maggi, 1069 Messinger Rd., Grants Pass, OR (US) 97526

( * ) Notice: Subject to any disclaimer, the term of this patent is extended or adjusted under 35 U.S.C. 154(b) by 543 days.

(21) Appl. No.: 10/382,349

(22) Filed: Mar. 4, 2003

Related U.S. Application Data

(60) Provisional application No. 60/410,466, filed on Sep. 13, 2002, provisional application No. 60/372,259, filed on Apr. 12, 2002, provisional application No. 60/361,672, filed on Mar. 4, 2002.

(51) Int. Cl.
*C11D 7/50* (2006.01)

(52) U.S. Cl. ..... 510/130; 510/138; 510/365

(58) Field of Classification Search ..... 134/40; 510/365

See application file for complete search history.

(56) References Cited

U.S. PATENT DOCUMENTS

| | | | | | |
|---|---|---|---|---|---|
| 2,388,614 | A | | 11/1945 | Kirby et al. | |
| 3,177,149 | A | | 4/1965 | Wood et al. | |
| 3,666,857 | A | | 5/1972 | Russell | |
| 4,168,255 | A | * | 9/1979 | Lewis et al. | 524/340 |
| 4,251,383 | A | * | 2/1981 | Kemp | 510/433 |
| 4,460,488 | A | * | 7/1984 | Grollier et al. | 510/119 |
| 4,477,361 | A | | 10/1984 | Sperti et al. | |
| 4,762,522 | A | * | 8/1988 | Maue | 8/94.19 R |
| 4,919,846 | A | * | 4/1990 | Nakama et al. | 510/433 |
| 5,213,624 | A | | 5/1993 | Williams | |
| 5,573,702 | A | * | 11/1996 | Bonnechere et al. | 510/417 |
| 5,604,195 | A | * | 2/1997 | Misselyn et al. | 510/400 |
| 5,826,546 | A | * | 10/1998 | Epstein | 119/651 |
| 5,906,992 | A | | 5/1999 | Fonsny et al. | |
| 6,010,993 | A | | 1/2000 | Romano et al. | |
| 6,019,963 | A | | 2/2000 | Kling et al. | |
| 6,136,778 | A | | 10/2000 | Kamiya | |
| 6,150,318 | A | * | 11/2000 | Silvester et al. | 510/284 |
| 6,180,582 | B1 | | 1/2001 | Durbut et al. | |
| 6,228,832 | B1 | * | 5/2001 | Kinscherf et al. | 510/417 |
| 6,380,410 | B1 | * | 4/2002 | Oftring et al. | 554/149 |
| 6,462,010 | B1 | * | 10/2002 | Aszman et al. | 510/417 |
| 6,518,232 | B1 | * | 2/2003 | Mertens et al. | 510/417 |
| 6,544,530 | B1 | * | 4/2003 | Friedman | 424/400 |

OTHER PUBLICATIONS

"Chromopol® UFB/W, Fatliquoring Agent for Garment and Other Soft Leathers," 2833/1001, TFL Ledertechnik GmbH & Co. KG, 2pp. (1999).

"Borron® SE, Degreasing Agent for Pelts," 2877/1001, TFL Ledertechnik GmbH & Co. KG, 2pp. (2000).

"Borron® SAF," 3352/1001, TFL Ledertechnik GmbH & Co. KG, 1p. (1999).

"Genapol X-080," Roche Molecular Biochemicals, p. 151 (2001/2002).

"New Luster for the Fleece's Gold," *Chemical Week*, Specialties p. 36, 3pp. (Jan. 7, 1976).

"Lanolin, USP," Fancor Specifications, 4pp. (Jun. 12, 1999).

* cited by examiner

*Primary Examiner*—Gregory Webb
(74) *Attorney, Agent, or Firm*—Klarquist Sparkman, LLP

(57) ABSTRACT

Compositions including a degreaser, a dispersant, a fatliquor (for example a combination of sulfited synthetic spermwhale oil, neatsfoot oil, and coconut oil), and optionally Myrtaceae oil (for example the oil from a plant in the *Melaleuca* genera, such as *Melaleuca alternifolia*), and lanolin are disclosed. Such compositions are used to clean and condition any article, but in particular are used to clean and condition animal skins, such as sheepskin, or animal hairs, such as sheep's wool, and products made therefrom. In some examples, such compositions have an anti-microbial effect imparted by at least one component having anti-microbial properties. Such compositions can increase retention of the anti-microbial component(s) in a cleaned article, even under high-temperature washing conditions. These compositions are effective to clean and/or condition animal hairs, such as wool, and products containing animal hairs while leaving the cleaned article soft to the touch.

15 Claims, No Drawings

COMPOSITIONS AND METHODS FOR CLEANING AND CONDITIONING

CROSS REFERENCE TO RELATED APPLICATION

This application claims the benefit of the earlier filing dates of prior U.S. provisional application Ser. No. 60/410,466 filed on Sep. 13, 2002, U.S. provisional application Ser. No. 60/372,259 filed on Apr. 12, 2002, and U.S. provisional application Ser. No. 60/361,672 filed on Mar. 4, 2002. Applicant's prior provisional applications are incorporated herein by reference.

FIELD

Embodiments of a composition, and methods for its use and manufacture, for cleaning and conditioning a variety of materials, particularly for cleaning and conditioning animal skin, hair, and other items including animal hair and skin, are disclosed.

BACKGROUND

Wool and other types of animal hair are used in many items, such as in yarn, garments, and blankets. Before wool (i.e., the hair from sheep, llamas, alpacas and other animals with similar hair) or other animal hair can be processed into such useful articles, it first must be shorn from the animal and treated to remove impurities, such as suint (sheep sweat and salt), grease (such as organic fatty acids), and surface soiling (such as dirt and vegetable matter). Wool scouring, one of the first wool processing steps, is used to remove suint and grease from the un-processed wool. Surface soiling may also be removed during scouring.

Additionally, animal skins, such as sheepskin and its related products have a wide variety of uses. For example, sheepskin is used for certain medical purposes, including covering and protecting wounds and sheepskin rugs are used for long-term, bed ridden patients in hospitals and managed care facilities. Sheepskin also has been used to make seat covers for automobile seats.

Sheepskin laundering is more complex than washing cotton or synthetic articles because it is mainly composed of proteins, which are sensitive to a variety of laundering conditions. For example, both the washing temperature and composition of the cleaning agent can drastically affect the integrity of sheepskin, both during and after laundering.

Sheepskin-laundering compositions typically evaporate during the washing process, thereby decreasing their overall laundering effectiveness. This is especially apparent during high-temperature laundering, where such washing dries out and/or otherwise damages the article's fibers, eventually ruining the sheepskin after several washes. High-temperature laundering is required in many settings, particularly in hospitals for thermal disinfection. Furthermore, non-thermal disinfection typically requires the application of enzymes, phosphates, alkalis, peroxide, or bleach, any one of which may damage the tanned component of sheepskin. This has limited the use of sheepskin and related wool products in these environments.

SUMMARY

Embodiments of a composition for cleaning and conditioning any type of article that might be soiled (i.e., having any impurity in or on the article, such as grease, dirt, bacteria, and/or vegetable matter) are disclosed. In particular examples, the disclosed compositions are used to clean and condition animal skins, such as sheepskin, or animal hairs, such as sheep's wool, and products made therefrom. In some instances, the disclosed compositions are effective to clean and/or condition such articles without compromising the integrity of the washed article. Further, in some examples, the disclosed compositions have an anti-microbial effect imparted by at least one component having anti-microbial properties. In some instances, the disclosed compositions increase the retention of the anti-microbial component(s) of the compositions in the cleaned article, even under high-temperature washing conditions. In some cases these compositions are effective to clean and/or condition animal hairs, such as wool, and products containing animal hairs while leaving the cleaned article soft to the touch.

In some examples the disclosed compositions include a de-greaser, a dispersant, and one or more of a fatliquor, an oil from a member of the Myrtaceae family, such as a member of the *Melaleuca* genera, for example *Melaleuca alternifolia*, and lanolin. Such a composition can used to clean and condition animal skins, such as sheepskin, and/or to clean and condition animal hair such as wool, for example in wool scouring, and/or to clean and condition animal hair products, such as a wool product, for example wool clothing. The use of such compositions is not limited to animal hair products, but also can be used to clean and condition any other articles, such as cotton or synthetic clothing.

DETAILED DESCRIPTION

As stated above, disclosed embodiments of the present composition may include a degreaser, a dispersant, a fatliquor, an oil from a member of the Myrtaceae family, such as a member of the *Melaleuca* genera, for example *Melaleuca alternifolia*, lanolin, and various combinations of these ingredients. Each of these ingredients is discussed in more detail below. Applicant also provides definitions of certain terms used in this application. These definitions are provided solely to aid the reader, and should not be construed to provide a definition that is more narrow than would be understood by a person of ordinary skill in the art.

A. Degreaser

A surfactant is a surface-active agent, which is an agent that tends to accumulate at the surface of a substance or the interface between two substances. As used herein, a surfactant is any amphipathic molecule having detergent, emulsifying, and/or dispersant action.

A degreasing component is a surfactant with detergent and emulsifying action. Degreasers used with the present compositions may include one or more degreasing agents, particularly non-ionic degreasing agents, although the degreaser also may be anionic, cationic, and zwitterionic. Some examples of useful non-ionic degreasing agents include at least one fatty alcohol polyglycolic ether (fatty alcohol ethoxylates or propoxylates) having Formula 1

$$R(CH_2CH_2O)_nH \qquad \text{Formula 1}$$

where R is a fatty alcohol and n is an integer. The value of n is selected such that the hydrophilic-to-lipophilic balance (HLB) ((molecular weight of hydrophilic portion of molecule/molecular weight of whole molecule)×20) of the compound is from about 8 to about 20 (although not exactly 20 because then there would be no hydrophobic portion). For example, the HLB typically ranges from about 10 to about 18, more typically from about 12 to about 16. In general, the higher the HLB the greater the ability of the degreaser to emulsify oils and grease. Also, in general, the higher the HLB the less degreaser, and oil and grease residue, are left on the cleaned article. This is because degreasers with higher HLBs have greater solubility in water due to higher ethylene oxide content. With reference to Formula 1, n may vary from about 2 to about 20 and R is a linear or branched chain fatty alcohol having from about 4 to about 22 carbons. Compounds with longer chain fatty alcohols, such as those having 10 or more carbons, generally are more effective detergents, and therefore linear chain fatty alcohols having from about 10 to about 16 carbons are preferred. For example, in some instances R is dodecyl or isotridecyl and n is 8, such as isotridecylpoly(ethyleneglycolether)$_8$.

The degreaser generally contains a mixture of suitable compounds. In some instances R also can be any other fatty alcohol, such as a cyclic fatty alcohol (e.g. phenol) or an alkylated cyclic fatty alcohol such as octyl phenol or nonyl phenol. If a propoxylate is used the same HLB parameters apply and one of skill in the art could determine appropriate compounds within these parameters. In some instances the de-greaser includes other fatty alcohols or derivatives of such that are suitable for degreasing animal skins and hair such as wool, pelts, sheepskin and the like.

Examples of suitable, commercially available degreasers can be selected from the group consisting of "Borron SE-G," Borron-TS, Triton CG-110 and Triton XL-80N. The degreasers can be used either alone, or in combination with any of the degreasers described herein. "Borron SE-G," is commercially available from TFL USA/Canada, Inc. of Greensboro, N.C. "Borron-TS," also available from TFL, is generally considered to be a milder degreaser (i.e., a less effective emulsifier, e.g., having an HLB closer to 8 than 18) than Borron SE-G and, in some cases, is used for cleaning and/or conditioning delicate articles. Triton CG-110 and Triton 80N are available from Dow Chemical, Inc., of Midland, Mich. The inclusion of Triton-based degreasers allows disclosed compositions to be used in a wider range of applications including cosmetic, toiletry, and industrial applications. Alternatively, the degreaser can be selected from other sources, commercial or non-commercial, and can be used alone or in combination, depending upon the desired application.

Working embodiments of the present composition typically include degreasers in amounts ranging from about 40% to about 95% by weight of the active, non-water components of the composition (hereinafter wt %). This percentage varies depending upon the other components and relative percentages thereof in the composition, as indicated by the working embodiments provided as working examples below.

B. Dispersant

A dispersant is an agent that causes particles, such as soil particles, components of the disclosed composition, and emulsified grease, to disperse throughout a solution. Embodiments of the present compositions include in some instances at least one sulfated fatty alcohol (in general, $RSO_4$, where, for example, R is an alcohol having from 4 to 22 carbons, such as lauryl or cetyl alcohol—however, one or more $SO_4$ groups can be and typically are bonded to more than one carbon of R) capable of distributing one or more of the components of the disclosed laundering composition throughout an aqueous solution. For example, when an embodiment of the disclosed composition is used to clean and/or condition an article in a conventional laundry machine, the dispersant causes components of the disclosed composition to disperse throughout the wash water. More specifically, the dispersant is provided to distribute hydrophilic components, such as *Melaleuca alternifolia* oil, fatliquor, and/or lanolin, into the fibers of laundered articles. Other types of dispersants can additionally or alternatively be included so long as the function of the disclosed composition is not impaired.

One example of a suitable dispersant is referred to in the laundering industry as "Borron SAF-G," and is commercially available from TFL USA/Canada, Inc. of Greensboro, N.C. Another suitable dispersant is "Tergitol 15-S-7" from Dow Chemical. Other dispersants, additionally or alternatively may be used to provide a laundering composition within the scope of the composition disclosed herein.

Disclosed embodiments of the present composition include at least one dispersant in amounts ranging from about 1.5 wt % to about 5 wt % of the composition, with approximately 3 wt % of the composition being typical. However, the weight percentage of the dispersant may vary depending upon the other components and relative percentages thereof in the composition.

C. Fatliquoring Agent

The disclosed compositions also can include a fatliquoring agent. A fatliquoring agent is an agent that can deposit oil on or in the articles being washed. A fatliquor typically includes an oil, such as an animal, vegetable, or synthetic oil. Examples of suitable oils can be selected, for example and without limitation, from the group consisting of mineral oil, castor oil, neatsfoot oil, cod oil, coconut oil, sperm whale oil, synthetic versions of any such oil that has been adapted to be miscible with water, and combinations of such oils. Suitable fatliquors are selected so that the oil stays dispersed in an aqueous composition, thereby allowing the oil to penetrate the article being washed rather than simply forming a film on the wash water. In some cases, an oil is combined with a surfactant to form an aqueous emulsion. However, in other cases an oil is modified such that it becomes water miscible without using an emulsifying agent.

Sulfur-oxygen analogs of the oils are suitable for use with compositions of the present invention. Methods of making such compounds are known in the art and such compounds are available commercially.

For example, sulfated oils (in general, $RSO_4$ where R is hydrocarbon chain having from 4 to 26 carbons or more—however, one or more $SO_4$ groups can be and typically are bonded to more than one carbon of R) are used frequently because they give good, fine oil dispersions. Sulfated oils can be prepared by treating oils with sulfuric acid at a temperature of 10 to 20° C., and then washing the product with a strong salt solution to remove excess acid. The salt is used to prevent the sulfated oil from emulsifying with the water. Soda ash can be added to form the sodium salt of the sulfated oil and to neutralize the last traces of the acid. The more the oil is sulfated, which is to say, the more sulfuric acid that has been fixed, the greater will be its stability to acid and the more thorough its penetration into the fibers of the article being washed. However, increasing the amount of sulfation or water miscibility, decreases the "oiliness" of the oil and therefore its lubricating ability. U.S. Pat. No. 4,741,738 describes a process for sulfating oils with sulfuric acid (as well as reactions with $SO_3$) and is herein incorporated by reference.

Sulfonated oils (in general, $RSO_3H$ where R is hydrocarbon chain having from 4 to 26 carbons or more—however, one or more $SO_3H$ groups can be and typically are bonded to more than one carbon of R) are prepared by a similar process, but using sulphonic acid and usually at a higher temperature. The sulphonated fatliquor contains the sulfonic group, which gives stability and can cause deeper penetration into fibers under acid conditions.

In some cases an oil is sulfited (in general, $RSO_3$ where R is hydrocarbon chain having from 4 to 26 carbons or more—however, one or more $SO_3$ groups can be and typically are bonded to more than one carbon of R). In an example of this process, the oil is mixed with a strong solution of sodium bisulfite ($NaHSO_3$), while the mixture is aerated by means of compressed air. Sulfited oils behave in a manner similar to sulfated oils, but may be more acid stable and afford deeper lubrication.

The fatliquoring agent additionally or alternatively may include other substances that are capable of moisturizing articles during laundering.

In some cases the fatliquoring agent includes a synthetic sperm whale oil, neatsfoot oil, and/or coconut oil. In some instances such oils are sulfited. In particular cases a combination of sulfited synthetic spermwhale oil, neatsfoot oil, and coconut oil is used. One example of such a suitable fatliquoring agent is referred to in the laundering industry as "Chromopol UFB-G," and is commercially available from TFL USA/Canada, Inc. of Greensboro, N.C. Another suitable fatliquor that is a synthetic spermwhale oil based fatliquor is "Atlasol 160-S" from Atlas Refinery. "Lipoderm Liquor WF" from BASF can also be used.

The fatliquoring agent increases the solubility in water of the oil of the member of the Myrtaceea family, such as a member of the *Melaleuca* genera, for example *Melaleuca alternifolia*, which can be included in the disclosed compositions. This allows the *Melaleuca alternifolia* oil, for example, to penetrate more deeply into the article being washed. This increases the retentive properties of the oil of member of the Myrtaceea family, for example, *Melaleuca alternifolia*, which are discussed in more detail below. As used herein, retentive refers to the ability to retain certain components, or their constituents, within the hide/fibers of the article being washed, without a loss in the functional activity of that component. For example, retaining the oil of the member of the Myrtaceea family, for example, *Melaleuca alternifolia* allows sheepskins to be thermally disinfected (by high temperature washing) between uses without requiring administration of an additional bacteriostat to the laundered article. As such, the fat liquor can increase the longevity of the beneficial effects provided by the oil of the member of the Myrtaceea family, for example, *Melaleuca alternifolia*, such as the ability to repel dust mites, to inhibit bacterial and viral growth, and to stimulate a patient's immune system.

To determine the increased retention of *Melaleuca alternifolia* oil caused by the fat liquor in an article, working embodiments of the present composition were formulated and used to wash sheepskin. Other sheepskin samples were washed with embodiments of the disclosed composition that did not include *Melaleuca alternifolia* oil. A composition comprising a degreaser, a dispersant, and Chromopol UFB-G as a fat liquor increased the retention of *Melaleuca alternifolia* oil in sheepskins 10-fold over a composition of the same degreaser and dispersant, but without the Chromopol UFB-G. Accordingly, the inclusion of a combination of sulfited synthetic spermwhale oil, neatsfoot oil, and coconut oil in a composition comprising a degreaser, a dispersant and *Melaleuca alternifolia* oil can increase the retention of *Melaleuca alternifolia* oil at least about 10 times over a similar composition without a fatliquor. In articles treated with the disclosed composition the retention of the *Melaleuca alternifolia* oil was evidenced by an increased effectiveness in killing dust mites after washing over articles treated with a similar composition that did not contain a fatliquor. Accordingly the disclosed compositions including *Melaleuca alternifolia* oil and fatliquor can significantly inhibit the presence of dust mites on or in articles washed with the disclosed composition even after washing. For example, such disclosed compositions can kill dust mites exposed to a washed article (e.g., on or in washed articles) for a period of at least one week after washing, typically for a period of two weeks or more. In particular, the inclusion of a sulfited synthetic spermwhale oil can increase the retention of *Melaleuca alternifolia* oil at least about 10 times over a similar composition without a fatliquor. Other fatliquors that do not contain such a combination, are less effective in retaining *Melaleuca alternifolia* oil.

In working embodiments, the fatliquor was used in amounts ranging from about 0.1 wt % to about 5 wt % of the composition, typically from about 0.5 wt % to about 5 wt %, and in some cases about 3 wt %; however the percentage may vary depending upon the other components and relative percentages thereof in the composition.

D. Myrtaceae oil

An oil from a member of the Myrtaceae family is an oily composition extracted from the leaves or other parts of the plant (Myrtaceae oil). Such oils contain anti-biotic and anti-fungal constituents, such as terpenes, for example, monoterpenes, sesquiterpenes, and their related alcohols. In some cases the member of the Myrtaceea family is a member of the *Eucalyptus* genera such as *Eucalyptus ficifolia*. In other cases the member Myrtaceea family is a member of the *Melaleuca* genera, for example *Melaleuca alternifolia*. *Melaleuca alternifolia* oil is an oily composition extracted from the leaves of the Australian Tea tree (*Melaleuca alternifolia*). It is native to Australia and more particularly Northern New South Wales. *Melaleuca alternifolia* oil typically contains over 100 constituents, mostly terpenes such as monoterpenes, sesquiterpenes, and their related alcohols. Terpinen-4-ol is typically the most prevalent constituent and is responsible for most of *Melaleuca alternifolia's* inherent antimicrobial activity. *Melaleuca alternifolia* oil has antifungal properties and is effective against dust mites, a known cause of allergen for asthma sufferers.

As used herein the Myrtaceae oil component may include naturally occurring Myrtaceae oil and/or components and derivates thereof. For example, the Myrtaceae oil component may include selected components, or elements, of naturally occurring *Melaleuca alternifolia* oil. As a further example, the components may be selected to enhance the antiseptic or antimicrobial (and/or miticidal) properties, healing properties, to remove or reduce less active or inert components, or to reduce or remove aromatics.

In some examples the Myrtaceae oil component comprises about 20% or more terpinen-4-ol, more typically about 20% to about 30%, or about 30% to about 35% terpinen-4-ol, most typically about 33.5%, and sometimes about 35% to about 40%. In some cases the Myrtaceae oil component comprises an even greater percentage of terpinen-4-ol.

*Melaleuca alternifolia* oil is available in pharmaceutical, cosmetic, and technical grades. In some instances pharmaceutical grade *Melaleuca alternifolia* oil is used in the disclosed compositions due to its increased sanitization properties. One example of suitable pharmaceutical grade *Melaleuca alternifolia* oil is referred to in the laundering industry as "Melablend 10," and is commercially available from The Australian Essential Oil Company of Coraki, Australia. Melablend 10 is characterized by its anti-mite and biocidal properties, relative to other grades or forms of *Melaleuca alternifolia* oil. Melablend 10 also includes oil from the *Melaleuca quinquenervia*. Melablend 10 contains on average about 33.5% terpinen-4-ol by weight (typically about 31.1% to about 38%), about 18.9%-terpinene (typically about 17% to about 25%), and lesser amount of other constituents. In other instances a technical, cosmetic or other grade of *Melaleuca alternifolia* is used so long as it functions as described above for a particular application.

In working examples, the disclosed embodiments of the composition included from about 1.5 wt % to about 5 wt % of *Melaleuca alternifolia* oil, with typical formulations having approximately 3 wt % of *Melaleuca alternifolia* oil.

Due to the high boiling point of its constituents, the Myrtaceae oil resists evaporation during laundering, even at the high temperatures that are often required for thermal disinfection. For example, many medical and hospital applications require sheepskins and other bedding materials and garments to be washed at a temperature at 150° F. or more, including temperatures in the range of approximately 180° F. or more. The physical properties of Myrtaceae oil inhibit the evaporation of the other components, the fatliquor and lanolin in particular, from the article being washed. This inhibits, and in some cases substantially prevents, the fibers of the washed article from drying out during washing. As used herein, drying out refers to the loss of fatty or greasy substances that normally surround the fibers of the washed article to keep them moist and improve their strength. Such a loss can occur during laundering, especially at high temperatures, and can severely damage articles such as sheepskin.

E. Lanolin

Lanolin (also known as wool wax) is a wax obtained from the wool of sheep. In its pure form it primarily includes a mixture of esters and poly-esters of high molecular weight alcohols (such as sterols) and fatty acids. As used herein, lanolin includes lanolin in its pure form, and/or lanolin derivatives. For example, the lanolin can include a combination of bisulfated forms of lanolin.

Lanolin can be included in the disclosed compositions and acts to regulate the moisture and softness of the laundered article, similar to the fatliquor. When compositions including lanolin are used to wash articles, such as woolen articles, the softness of the article after washing is significantly greater than when washed with other wool washes that do not contain lanolin.

Lanolin can be obtained from any suitable source, including wool. One example of a suitable lanolin component is referred to in the laundering industry as "Coripol BZN-G," and is commercially available from TFL USA/Canada, Inc. of Greensboro, N.C. As another example, Propilon BNV/W, referred to in the art as "bleached lanolin," may be used and typically provides the finished composition with a light clear color. Propilon BNV/W also is available from TFL USA/Canada, Inc. It should be appreciated that the laundering compositions can include any other forms of lanolin, or combinations of such.

In some cases the lanolin component is from about 0.5 wt % to about 3 wt % of the disclosed composition with typically compositions including about 1 wt % to about 2 wt % of lanolin; however the percentage may vary depending upon the other components and relative percentages thereof in the composition.

F. Biocide

Although the Myrtaceae oil component of the composition provides the composition with antimicrobial properties, the composition can include additional components, such as a biocide, to protect against long-term degradation of the composition and to inhibit biological growth. When present in the composition, an effective amount of the biocide is used, typically which amount is in the range of from about 0.5 wt % to about 2 wt % of the active, non-water components of the composition. One example of a suitable biocide is referred to in the laundering industry as "Kathon CG/ICP II," and is commercially available from Rohm and Haas of Philadelphia, Pa. Other suitable biocides or combinations thereof may additionally or alternatively be included, so long as the effectiveness of the resulting composition is not impaired.

G. Water

The active components of the laundering compositions can be diluted with water. In some cases the disclosed compositions are from about 40% to about 80% water by total weight of the composition (i.e., the weight of the active non-water components plus the weight of the water). However, the optimum percentage of water used in a particular composition may vary depending upon such factors as the other components, the relative percentages of the other components in the composition, the particular type of article to be washed, and the washing conditions. Accordingly, the amount of water included in the disclosed compositions can vary from essentially none to approximately 90% of the total weight of the composition. Furthermore, because the disclosed compositions typically are added to an aqueous environment to wash articles, the compositions will be diluted at that time regardless of their initial makeup. As such, a disclosed composition can be prepared initially with little or no water, in which case it will be in a concentrated form. In typical working formulations the disclosed compositions initially contain at least some water, such as from about 2% to about 25% of water by total weight of the composition, or more, to promote effective mixing and stabilization of the other components. In some cases, the water may have additional or alternative functions, such as helping to remove water-soluble materials embedded in the sheepskin or other articles to be washed. However, as discussed below, water can be omitted without impairing the use of the disclosed compositions.

H. Other Additions

The above-described laundering compositions also can be adapted to specific applications, such as through the inclusion of an additional component or components, such as those described below. For example, the composition may include a solvent or combination of solvents specifically adapted for treating a certain type of stain. Commonly occurring stains for which specific formulations may be used include one or more of the following: ink, rust, red wine, food stains, and other beverage stains. Other materials that may be incorporated into the composition include one or more of the following: sizing, moth repellents, water repellents, UV-inhibitors, stain repellents, brighteners, dewrinklers, perfumes and odor-removing substances, such as substances adapted to remove smoke, urine, and pet odors. Another optional component is a defoaming agent, which is an agent adapted to reduce the foam produced as the composition is mixed and/or agitated, during formation and/or during use.

The disclosed compositions typically have a somewhat acidic pH, such as a pH in the range of from approximately 6 to approximately 6.2. However, the pH may vary depending upon the particular components and the compositions thereof, for example the pH of the disclosed composition can be from about 5 to 7, more typically from about 6 to 7, with working formulations from about 6.0 to about 6.2 as noted above. The compositions also can be balanced and/or adjusted through the addition of appropriate buffers, or acidic or basic components. Therefore, the disclosed composition can be acidic, basic, or neutral.

As discussed herein, the disclosed composition is suitable for a variety of laundering applications including the washing of sheepskin, wool, and a variety of fabrics, garments and other articles, as well as for other cosmetic, toiletry and industry-related applications. Several examples of the disclosed compositions are presented in the following tables for the purpose of illustration. However, these illustrative compositions are not intended to provide an exclusive list of compositions within the scope of the appended claims. The particular components and relative concentrations of the claimed compositions may vary, such as discussed above. As also discussed above, the amount of water in the composition may vary, with some compositions including no water and others containing water as a majority component. Similarly, the water concentration is variable because in use the composition typically will be added to a washing machine or other apparatus that contains water. Accordingly, the following tables contain compositions with weight percentages expressed either with water included or excluded, and sometimes both. For the purpose of providing more specific examples, the following tables include trade names of exemplary sources for the recited active components. It should be further understood that other sources and functionally equivalent components may be substituted for these sources without departing from the scope of the appended claims.

COMPOSITION #1

| Active Component | Total weight % | Wt % |
|---|---|---|
| Coripol BZN-G (lanolin comp.) | 0.85 | 2.80 |
| *Melaleuca alternifolia* (Technical Grade) | 1.0 | 3.20 |
| Borron SE-G (surfactant) | 26.00 | 83.90 |
| Chromopol UFB-G (fatliquor) | 2.00 | 6.40 |
| Borron SAF-G (dispersant) | 1.00 | 3.20 |
| Water | 69.00 | |
| Kathon CG/ICP II (biocide) | 0.15 | 0.50 |

COMPOSITION #2

| Active Component | Total weight % | Wt % |
|---|---|---|
| Coripol BZN-G (lanolin comp.) | 0.85 | 2.80 |
| *Melaleuca alternifolia* (Melablend 10) | 1.00 | 3.20 |
| Borron SE-G (surfactant) | 27.00 | 87.10 |
| Chromopol UFB-G (fatliquor) | 1.00 | 3.20 |
| Borron SAF-G (dispersant) | 1.00 | 3.20 |
| Water | 69.00 | |
| Kathon CG/ICP II (biocide) | 0.15 | 0.50 |

COMPOSITION #3

| Active Component | Total weight % | Wt % |
|---|---|---|
| Coripol BZN-G (lanolin comp.) | 0.85 | 2.90 |
| *Melaleuca alternifolia* (Melablend 10) | 1.00 | 3.45 |
| Borron SE-G (surfactant) | 25.00 | 86.20 |
| Chromopol UFB-G (fatliquor) | 1.00 | 3.45 |
| Borron SAF-G (dispersant) | 1.00 | 3.45 |
| Water | 71.00 | |
| Kathon CG/ICP II (biocide) | 0.15 | 0.55 |

COMPOSITION #4

| Active Component | Total weight % | Wt % |
|---|---|---|
| Propilon BVN/W (lanolin comp.) | 0.85 | 3.50 |
| *Melaleuca alternifolia* (Melablend 10) | 1.00 | 4.10 |
| Borron SE-G (surfactant) | 20.00 | 82.10 |
| Chromopol UFB-G (fatliquor) | 1.00 | 4.10 |
| Borron SAF-G (dispersant) | 1.00 | 4.10 |
| Water | 75.65 | |
| Kathon CG/ICP II (biocide) | 0.50 | 2.10 |

COMPOSITION #5

| Active Component | Total weight % | Wt % |
|---|---|---|
| Propilon BVN/W (lanolin comp.) | 0.85 | 3.50 |
| *Melaleuca alternifolia* (Melablend 10) | 1.00 | 4.10 |
| Borron TS (surfactant) | 20.00 | 82.10 |
| Chromopol UFB-G (fatliquor) | 1.00 | 4.10 |
| Borron SAF-G (dispersant) | 1.00 | 4.10 |
| Water | 75.65 | |
| Kathon CG/ICP II (biocide) | 0.50 | 2.10 |

COMPOSITION #6

| Active Component | Total weight % | Wt % |
|---|---|---|
| Propilon BVN/W (lanolin comp.) | 0.85 | 3.60 |
| *Melaleuca alternifolia* (Melablend 10) | 1.00 | 4.30 |
| Borron TS (surfactant) | 20.00 | 85.65 |
| Borron SAF-G (dispersant) | 1.00 | 4.30 |
| Water | 76.65 | |
| Kathon CG/ICP II (biocide) | 0.50 | 2.15 |

COMPOSITION #7

| Active Component | Total weight % | Wt % |
|---|---|---|
| Propilon BVN/W (lanolin comp.) | 0.85 | 3.60 |
| *Melaleuca alternifolia* (Melablend 10) | 1.00 | 4.30 |
| Triton CG-110 (surfactant) | 20.00 | 85.65 |
| Borron SAF-G (dispersant) | 1.00 | 4.30 |
| Water | 76.65 | |
| Kathon CG/ICP II (biocide) | 0.50 | 2.15 |

COMPOSITION #8

| Active Component | Total weight % | Wt % |
|---|---|---|
| Propilon BVN/W (lanolin comp.) | 0.85 | 3.60 |
| *Melaleuca alternifolia* (Melablend 10) | 1.00 | 4.30 |
| Triton CG-110 (surfactant) | 20.00 | 85.65 |
| Chromopol UFB-G (fatliquor) | 1.00 | 4.30 |
| Borron SAF-G (dispersant) | 1.00 | 4.30 |
| Water | 76.65 | |
| Kathon CG/ICP II (biocide) | 0.50 | 2.15 |

COMPOSITION #9

| Active Component | Total weight % | Wt % |
|---|---|---|
| Propilon BVN/W (lanolin comp.) | 0.85 | 3.60 |
| *Melaleuca alternifolia* (Melablend 10) | 1.00 | 4.30 |
| Triton XL-80N (surfactant) | 20.00 | 85.65 |
| Chromopol UFB-G (fatliquor) | 1.00 | 4.30 |
| Borron SAF-G (dispersant) | 1.00 | 4.30 |
| Water | 76.65 | |
| Kathon CG/ICP II (biocide) | 0.50 | 2.15 |

COMPOSITION #10

| Active Component | Total weight % | Wt % |
|---|---|---|
| Propilon BVN/W (lanolin comp.) | 0.85 | 3.60 |
| *Melaleuca alternifolia* (Melablend 10) | 1.00 | 4.30 |
| Triton XL-80N (surfactant) | 20.00 | 85.65 |
| Borron SAF-G (dispersant) | 1.00 | 4.30 |
| Water | 76.65 | |
| Kathon CG/ICP II (biocide) | 0.50 | 2.15 |

COMPOSITION #11

| Active Component | Total weight % | Wt % |
|---|---|---|
| Propilon BVN/W (lanolin comp.) | 0.85 | 3.50 |
| *Melaleuca alternifolia* (Melablend 10) | 1.00 | 4.10 |
| Borron SE-G (surfactant) | 5.00 | 20.50 |
| Triton XL-80N (surfactant) | 15.00 | 61.60 |
| Chromopol UFB-G (fatliquor) | 1.00 | 4.10 |
| Borron SAF-G (dispersant) | 1.00 | 4.10 |
| Water | 75.65 | |
| Kathon CG/ICP II (biocide) | 0.50 | 2.10 |

COMPOSITION #12

| Active Component | Wt % |
|---|---|
| Coripol BZN-G (lanolin comp.) | 2.80 |
| *Melaleuca alternifolia* (Melablend 10) | 3.20 |
| Borron SE-G (surfactant) | 87.10 |
| Chromopol UFB/G (fatliquor) | 3.20 |
| Borron SAF-G (dispersant) | 3.20 |
| Kathon CG/ICP II (biocide) | 0.50 |

COMPOSITION #13

| Active Component | Wt % |
|---|---|
| Coripol BZN-G (lanolin comp.) | 1.70 |
| *Melaleuca alternifolia* (Melablend 10) | 3.45 |
| Borron SE-G (surfactant) | 86.25 |
| Chromopol UFB/G (fatliquor) | 3.45 |
| Borron SAF-G (dispersant) | 3.45 |
| Kathon CG/ICP II (biocide) | 1.70 |

COMPOSITION #14

| Active Component | Wt % |
|---|---|
| Coripol BZN-G (lanolin comp.) | 1.70 |
| *Melaleuca alternifolia* (Melablend 10) | 3.45 |
| Borron SE-G (surfactant) | 86.25 |
| Chromopol UFB/G (fatliquor) | 3.45 |
| Borron SAF-G (dispersant) | 3.45 |
| Kathon CG/ICP II (biocide) | 1.70 |

COMPOSITION #15

| Active Component | Total weight % (active components and water) |
|---|---|
| Triton XL-80N | 15 |
| Borron SE | 5 |
| *Melaleuca alternifolia* (Aus. Essential Oil's Melablend 10) | 1 |
| Propilon BNV/W | .85 |
| Chromopol UFB-G | 1 |
| Borron SAF-G | 1 |
| Water | 75 |
| Kathon CG/ICP II | .15 |

COMPOSITION #16

| Active Component | Total Weight % |
|---|---|
| Triton XL-80N | 15 |
| Borron SE | 5 |
| *Melaleuca alternifolia* (Aus. Essential Oil's Melablend 10) | 1 |
| Propilon BNV/W | .85 |
| Borron SAF-G | 1 |
| Water | 77 |
| Kathon CG/ICP II | .15 |

COMPOSITION #17

| Active Component | Total Weight % |
|---|---|
| Triton XL-80N | 15 |
| Borron SE | 5 |
| *Melaleuca alternifolia* (Aus. Essential Oil's Melablend 10) | 1 |
| Propilon BNV/W | .85 |
| Borron SAF-G | 1 |
| Water | 76 |
| Kathon CG/ICP II | .15 |

COMPOSITION #18

| Active Component | Total Weight % |
|---|---|
| Borron SE-G | 5 |
| Triton XL-80N | 5 |
| Borron TS | 10 |
| Propilon BNV/W | .85 |
| *Melaleuca alternifolia* (Aus. Essential Oil's Melablend 10) | 1 |
| Chromopol UFB-G | 1 |
| Borron SAF-G | 1 |
| Water | 76 |
| Kathon CG/ICP II | .15 |

COMPOSITION #19

| Active Component | Total Weight % |
|---|---|
| Borron SE-G | 5 |
| Triton XL-80N | 5 |
| Borron TS | 10 |
| Propilon BZN-G | .85 |
| *Melaleuca alternifolia* (Aus. Essential Oil's Melablend 10) | 1 |
| Chromopol UFB-G | 1 |
| Borron SAF-G | 1 |
| Water | 76 |
| Kathon CG/ICP II | .15 |

COMPOSITION #20

| Active Component | Total Weight % |
|---|---|
| Borron SE-G | 5 |
| Triton XL-80N | 5 |
| Borron TS | 10 |
| Propilon BZN-G | .85 |
| *Melaleuca alternifolia* (Aus. Essential Oil's Melablend 10) | 1 |
| Chromopol UFB-G | 1 |
| Borron SAF-G | 1 |
| Water | 75.5 |
| Kathon CG/ICP II | .15 |
| AAO46472 Fresh Wash Fragrance | .50 |

COMPOSITION #21

| Active Component | Total Weight % |
|---|---|
| Borron SE-G | 5 |
| Triton XL-80N | 5 |
| Borron TS | 10 |
| Propilon BZN-G | .85 |
| *Melaleuca alternifolia* (Aus. Essential Oil's Melablend 10) | 1 |
| Chromopol UFB-G | 1 |
| Borron SAF-G | 1 |
| Water | 75.5 |
| Kathon CG/ICP II | .15 |
| AAO46472 Fresh Wash Fragrance (Arylessence) | .50 |

COMPOSITION #22

| Active Component | Total Weight % |
|---|---|
| Borron SE-G | 10 |
| Borron TS | 10 |
| Propilon BZN-G | .85 |
| *Melaleuca alternifolia* oil (Aus. Essential Oil's Melablend 10) | 1 |
| Chromopol UFB-G | 1 |
| Borron SAF-G | 1 |
| Water | 75.5 |
| Kathon CG/ICP II | .15 |
| AAO46472 Fresh Wash Fragrance (Arylessence) | .50 |

COMPOSITION #23

| Active Component | Total Weight % |
|---|---|
| Borron SE-G | 10 |
| Borron TS | 10 |
| Propilon BZN-G | .85 |
| *Melaleuca alternifolia* (Aus. Essential Oil's Melablend 10) | 1 |
| Chromopol UFB-G | 1 |
| Borron SAF-G | 1 |
| Water | 75.5 |
| Kathon CG/ICP II | .15 |
| AAO46472 Fresh Wash Fragrance (Arylessence) | .25 |

COMPOSITION #24

| Active Component | Total Weight % |
|---|---|
| Borron SE-G | 56 |
| Chromopol UFB-G | 2 |
| Borron SAF-G | 2 |
| Water | 40 |

COMPOSITION #25

| Active Component | Total Weight % |
|---|---|
| Borron SE-G | 66 |
| Chromopol UFB-G | 2 |
| Borron SAF-G | 2 |
| Water | 30 |

Making Disclosed Composition

The separate components of the disclosed compositions can be combined in any manner and in any order. Typically, the degreaser, fatliquor, and/or Myrtaceae oil and/or lanolin are combined first and mixed, then the dispersant is added (sometimes diluted in a small amount of water (1%–5% of water used if any) and mixed with the other components, then water is added if included and mixed with the other components, and then the biocide, if any, is added and mixed with the other components. Water preferably is added to the composition slowly to prevent excessive foaming.

One suitable method for making a composition that includes Myrtaceae oil, lanolin, and fatliquor includes mixing appropriate amounts of the degreaser, fatliquor, lanolin, and Myrtaceae oil in a containment vessel, such a plastic bucket. Next, an appropriate amount of the dispersant is typically diluted and mixed with a small amount of water in a separate vessel, and is then added to the containment vessel. Alternatively, the dispersant may be added directly to the mixture (without being first diluted and mixed with water), or at a later time during preparation so long as its addition does not impair the effectiveness of the laundering composition. After mixing, water typically is added to the composition. As discussed, a weight percentage in the range of 40% to 80% of the total weight of the composition has proven effective, but the amount of water added to the composition prior to use may vary dramatically. For example, in some cases, no water is added to the composition prior to use. A biocide may be added, if desired, to finish the formulation of the invented composition. The above-described formulations have been shown to effectively launder sheepskin, wool and related articles, including clothing, while increasing the longevity in the desired feel and sanitization of the washed article. It has also proven effective for washing down and fleece, and articles (including clothing) containing the same, as well as silks, linens and delicate blended fabrics.

An alternative method for preparing the invented laundering composition includes combining the active components so that, for example, the composition may be shipped or stored as a concentrate. Appropriate amounts of lanolin, de-greaser, and Myrtaceae oil are first combined and mixed together. A solution of the dispersant (diluted with water) is then added and mixed into the composition. If desired, a biocide and or fatliquor can then be added to the composition. The concentrate can then be diluted to any desired concentration. For example, the concentrate can be diluted with water to a less concentrated form for sale of the composition for later use, or the concentrate can be used directly in the laundering process in appropriate amounts, which amounts depend on the material to be cleaned, the amount of grease and dirt on in the material, and the properties of the water used in the laundering process. If the concentrate is to be diluted for later use this working formulation can be prepared at a temperature range of 20–30° Celsius, although it may be prepared at other temperatures, as desired.

The disclosed laundering composition is suitable for use in a variety of laundering/washing applications. In general, the disclosed compositions can be used to clean and/or condition any article by providing a disclosed composition and an article and washing the article with the disclosed composition. Washing can be by any known washing technique. Generally washing includes at least contacting the article with the composition, for example by applying the composition directly to the article, by diluting the composition in a container holding a liquid (such as water) and placing the article in the liquid, by placing the article in a container and providing a liquid and then the composition, or any other method of providing the article and the composition in a relationship such that the composition can clean and/or condition the article. Typically, some form of mechanical energy will be applied to the article to help the composition penetrate into the article and remove and trap (e.g., emulsify) impurities. Generally, even more liquid is used to rinse the composition and the trapped impurities from the article. For example, the article can be sprayed with water, immersed in water, or even rain can be used to rinse the article.

For example, to wash sheep, a disclosed composition can be applied directly to the wool and skin of the sheep (which may have been pre-wetted) and the mechanical energy applied can be manually rubbing the sheep. The composition and trapped impurities can be rinsed from the sheep simply by spraying the sheep with water.

As discussed, one useful application is the laundering of sheepskin and related hides. Other additional applications include the laundering of wool- and wool-related articles, such as clothing. As also discussed above, the composition is effective when used to launder articles at elevated temperatures, including temperatures in the range of from about 150° F. to about 180° F. or more, for example to about 212° F. However, the composition also can be used at lower temperatures, for example, any temperature at or above the melting point of water. In addition, several of the laundering compositions, such as those containing Triton CG-110, may be useful in cosmetic, toiletry, and/or industrial applications. In another example, compositions including mild forms of the degreaser, e.g. Triton-XL 80, can also be used to cleanse and sanitize live animals. More particularly, the disclosed compositions can be used to bathe, or otherwise clean, the coats of living animals, such as dogs, cats, horses, livestock, and the like.

The disclosed laundering compositions can be used in conjunction with a standard laundering apparatus, such as a household washing machine, to effectively launder the above-mentioned articles. Such laundering typically includes one or more cycles of agitation and rinsing of the article in a solution containing an appropriate amount of the invented laundering composition diluted in the water that is used in the washing machine or other apparatus. In another example, the disclosed compositions can be used in larger commercial and/or industrial washing apparatus.

The disclosed compositions are also well suited for use in tanneries to clean and/or finish tanned sheepskins and related animal hides. For such applications, the working formulation typically is prepared at approximately 60° Celsius, although higher or lower temperatures may be used. If concentrated, it is generally preferred to dilute the laundering composition approximately ten-fold with water. Alternatively, larger or smaller amounts of water, relative to the laundering composition, have also proven effective. It has been shown that approximately ten grams of laundering concentrate per one kilogram of sheepskin or related material, results in effective laundering without compromising the feel of the skin after washing. In addition, other forms of measurement, such as by volume may be employed without impairing the effectiveness of the disclosed laundering compositions. Such compositions have also been shown to be effective as a bath solution applied to tanned hides and sheepskin after dying and acidification, and used after dry-cleaning of such hides and the like.

In some cases the disclosed compositions are used to wash unprocessed wool, for example to scour wool. As discussed above, wool scouring is the washing of wool shorn from sheep (or other animal having wool) as an initial step of processing the wool into yarn or other useful form. Wool scouring typically involves washing the wool in bowls containing a disclosed composition and hot water (about 60° C. or 140° F.). Generally more than one bowl is used as the soiled wool is washed progressively in a number of bowls with the water and grease pressed out of the wool between bowls with rollers or equivalent apparatus. In some cases a wool scouring composition might include only a degreaser, a fatliquor, and a dispersant, such as in example compositions 25 and 25 and may not necessarily include lanolin or Myrtaceae oil, although either or both of these components are included in some cases.

The disclosed laundering composition effectively launders a variety of types of articles. The retentive properties provided by the fatliquor component, in combination with the biocidal properties of Myrtaceae oil, increase the longevity of a laundered article's sanitation and softness.

Although many specific examples of the disclosed compositions and methods for their use have been given above, these examples do not limit the scope of the appended claims.

The invention claimed is:

1. A cleaning and conditioning composition, comprising;

An oil from a member of the genera *Melaleuca;* a degreasing agent;

a dispersant; and a fatliquor comprising at least one sulfited oil.

2. The composition of claim 1, wherein the de-greasing agent comprises at least one non-ionic surfactant.

3. The composition of claim 2, wherein the non-ionic surfactant is a fatty alcohol polyglycolic ether.

4. The composition of claim 3, wherein the fatty alcohol polyglycolic ether has the formula $R(CH_2CH_2O)_nH$, wherein R is a fatty alcohol having from 10 to 22 carbons and n is an integer such that the hydrophilic to lipophilic balance of the at least one fatty alcohol polyglycolic ether is from about 8 to about 20.

5. The composition of claim 4, wherein n is an integer such that the hydrophilic to lipophilic balance of the at least one fatty alcohol polyglycolic ether is from about 10 to about 18.

6. The composition of claim 4, wherein n is an integer such that the hydrophilic to lipophilic balance of the at least one fatty alcohol polyglycolic ether is from about 12 to about 16.

7. The composition of claim 1, wherein fatliquor is selected from the group of sulfited oils consisting of synthetic sperm whale oil, neatsfoot oil, and coconut oil, and combinations thereof.

8. The composition of claim 1, wherein the dispersant comprises at least one sulfated fatty alcohol.

9. The composition of claim 1, wherein the oil from a member of the genera *Melaleuca* comprises from about 20% to about 40% terpinen-4-ol.

10. The composition of claim 1, wherein the member of genera *Melaleuca* is *Melaleuca alternifolia.*

11. The composition of claim 1, further comprising lanolin.

12. The composition of claim 1, wherein the degreasing agent comprises from about 40 wt % to about 95 wt % of the composition, the dispersant comprises from about 1.5 wt % to about 5 wt % of the composition, and the fatliquor comprises from about 0.5 wt % to about 5 wt % of the composition.

13. The composition of claim 12, wherein the oil from a member of the genera *Melaleuca* comprises from about 1.5 wt % to about 5 wt % of the composition.

14. The composition of claim 11, wherein the degreasing agent comprises from about 40 wt % to about 95 wt % of the composition, the dispersant comprises from about 1.5 wt % to about 5 wt % of the composition, the fatliquor comprises from about 0.5 wt % to about 5 wt % of the composition, the oil from a member of the genera *Melaleuca* comprises from about 1.5 wt % to about 5 wt % of the composition, and the lanolin comprises from about 0.5 wt % to about 2 wt % of the composition.

15. A cleaning and conditioning composition, comprising;

a degreasing agent comprising at least one nonionic surfactant, wherein the at least one non-ionic surfactant is a fatty alcohol polyglycolic ether having the formula $R(CH_2CH_2O)_nH$ where R is a fatty alcohol having from 10 to 22 carbons and n is an integer such that the hydrophilic to lipophilic balance of the at least one fatty alcohol polyglycolic ether is from about 12 to about 16, and wherein the degreasing agent comprises from about 40 wt % to about 95 wt % of the composition;

a dispersant comprising at least one sulfated fatty alcohol, wherein the dispersant is from about 1.5 wt % to about 5 wt % of the composition;

a fatliquor comprising a sulfited oil selected from the group comprising synthetic sperm whale oil, sulfited neatsfoot oil, and sulfited coconut oil and combinations thereof, wherein the fatliquor comprises about 0.5 wt % to about 5 wt % of the composition;

*Melaleuca alternifolia* oil, wherein the *Melaleuca alternifolia* oil comprises from about 20% to about 40% terpinen-4-ol, and wherein the *Melaleuca alternifolia* oil comprises from about 1.5 wt % to about 5 wt % of the composition; and lanolin, wherein the lanolin comprises about 0.5 wt % to about 2 wt % of the composition.

* * * * *